US006779454B2

(12) United States Patent
Mengisen et al.

(10) Patent No.: US 6,779,454 B2
(45) Date of Patent: Aug. 24, 2004

(54) PROCESS AND DEVICE FOR DETERMINING THE POSITION OF A PRINTED PAPER WEB

(75) Inventors: Jean-Claude Mengisen, Schönbühl (CH); Curt Munz, Konolfingen (CH)

(73) Assignee: Maschinenfabrik Wifag, Bern (CH)

( * ) Notice: Subject to any disclaimer, the term of this patent is extended or adjusted under 35 U.S.C. 154(b) by 0 days.

(21) Appl. No.: 10/264,333

(22) Filed: Oct. 3, 2002

(65) Prior Publication Data

US 2003/0066451 A1 Apr. 10, 2003

(30) Foreign Application Priority Data

Oct. 4, 2001 (DE) ..... 101 49 158

(51) Int. Cl.[7] ..... B41F 1/34

(52) U.S. Cl. ..... 101/485; 101/486; 101/211; 101/228

(58) Field of Search ..... 101/483, 484, 101/485, 486, 493, 211, 181, 226, 227, 228; 700/125; 382/112, 218; 250/559.44

(56) References Cited

U.S. PATENT DOCUMENTS

| | | | | |
|---|---|---|---|---|
| 4,736,446 A | * | 4/1988 | Reynolds et al. | 382/112 |
| 5,181,257 A | | 1/1993 | Steiner et al. | |
| 5,452,632 A | | 9/1995 | Durr et al. | |
| 5,806,430 A | | 9/1998 | Rodi | |
| 6,018,687 A | * | 1/2000 | Tabor | 700/125 |
| 6,050,192 A | | 4/2000 | Kipphan et al. | |

FOREIGN PATENT DOCUMENTS

| | | |
|---|---|---|
| DE | 43 21 179 | 1/1995 |
| DE | 196 32 674 | 4/1997 |
| DE | 198 55 177 | 6/2000 |
| EP | 0 127 831 | 12/1984 |

OTHER PUBLICATIONS

Bernd Ollech, Nov. 11, 1996, Die vernetzte Druckerei in der Praxis, Polygraph—20–96.

* cited by examiner

*Primary Examiner*—Eugene H. Eickholt
(74) *Attorney, Agent, or Firm*—McGlew and Tuttle, P.C.

(57) ABSTRACT

A process is provided for determining the position of a printed paper web in a printing press, especially in a rotary printing press. Reference values for determining the position from the image data of the preliminary printing stage are obtained. At least part of a printing style on the paper web is detected by at least one scanner. The reference values obtained from the image data of the preliminary printing stage are compared with the measured values detected by at least one sensor. The position of the printed paper web is determined from the result of the comparison. A device is provided for determining the position of a printed paper web in a printing press, especially in a rotary printing press, with a data processing device, in which reference values are generated from image data from the preliminary printing stage for determining the position. At least one sensor is provided for detecting at least part of a printing style on the paper web. A comparing device compares reference values and measured values with one another in order to determine the position of the printed paper web therefrom.

13 Claims, 3 Drawing Sheets

PROCESS AND DEVICE FOR DETERMINING THE POSITION OF A PRINTED PAPER WEB

FIELD OF THE INVENTION

The present invention pertains to a process and a device for determining the position of at least one printed web, preferably a paper web in a printing press, especially for determining the cutting position of a printed paper web in a rotary printing press for printing newspapers.

BACKGROUND OF THE INVENTION

Newspapers are produced predominantly according to the offset printing process. A plurality of paper webs are wound off from rolls in such a process, printed on in the printing units, and are finally folded and cut in the folder. While a paper web is running through the press, it is always in a tensioned state.

The paper comes into contact with water and printing ink during wet offset printing, as a result of which the stretching properties of the paper change. The addition of water and printing ink is not the same for all printing mechanisms. The paths traveled by the individual paper webs have different lengths. The stretching properties vary from one paper grade to the next, and there is a difference in the stretching behavior of the paper even within the same paper grade.

Double-width paper webs are divided into two or more strands in the direction of run after printing. The individual strands of a paper web may travel over different paths via turning bars before they are brought together into multilayer bundles.

The different strands are brought together into multilayer bundles before entering the folder and are folded in the direction of run of the webs. The bundles are subsequently cut in the folder at right angles to the direction of run in such a way that the cut is located outside the printing area of the pages. Errors in the cutting position cause the printed newspapers to become unable to be sold.

The cutting position can be adjusted by the printer by adjusting the web length between the printing mechanism and the cutting knife or the cutting cylinder by means of compensator rollers. It is also possible to set the cutting position by an equal adjustment of the angular position of the printing cylinders printing on the web and thus to do away with a compensator roller, which is also called a virtual main register. The cutting positions of the individual strands of a paper web can be set independently from one another by means of the compensator rollers of the secondary registers.

Difficulties arise concerning the correct cutting of the bundled webs in the folder from the different paths of the individual webs and strands and the different degrees of stretching, which the individual paper webs and strands undergo during their run through the printing press.

If similar productions are repeated, the suitable positions of the main registers and secondary registers are known and can be preset more or less accurately at the start of the production run. However, the printer usually must adjust the cutting positions manually at the beginning of the production run. This results in an amount of spoiled copies and a loss of time in the production.

Processes that make possible the automatic regulation of the cutting position have been known. Special markings, so-called marks, are printed along, which are detected by suitable optoelectronic sensors before the individual strands converge into multilayer bundles at the formers and thus yield measured values that can be used for the automatic measurement and regulation of the cutting position.

A large measuring mark on the printed paper web can be detected, e.g., by a simple optoelectronic sensor, e.g., a contrast scanner. However, large marks compromise the appearance of the printed product, e.g., the newspaper. Smaller marks, which are less disturbing, require more complicated optoelectronic sensors, e.g., CCD cameras, in conjunction with digital pattern recognition or image data processing. The technical effort for recognizing the marks increases, in general, with the decrease in the size of the marks.

Furthermore, processes have been known that can automatically measure and regulate the cutting position without the use of print marks. The crop mark is first set by the printer manually from the control panel. A reference signal is then formed by scanning the printing style on the paper web by optoelectronic sensors. The cutting position is subsequently determined automatically by comparing the current measured signal with the reference signal. The drawback of this process is that the printer must first set the cutting position manually. This means that the cutting position cannot be immediately regulated automatically at the start of a new production run. Moreover, it is also impossible to regulate the cutting position during a flying change from one edition to another without manual intervention. The manual interventions cause spoiled copies and loss of time in the production.

Another possibility of recognizing errors in the cutting position has been known from DE 199 10 835 C1 and it comprises the scanning of the printing style at two points. The first scanning at the outlet of the printing mechanism forms a reference, which can be compared with the scanning in front of the inlet of the former. The position error between the two measurement points can be determined from the correlation of the signals, and this error can then be corrected automatically by a corresponding regulation. The drawback of this process is that only the position error between the two measurement points is corrected and that a plurality of sensors must be used.

In another process known from DE 195 06 774 A1, a magnetic field of a mark is detected with a sensor. This process requires the printing of magnetizable marks, e.g., with colorless printing ink containing metal particles and has the drawback that these marks must be applied by means of an additional printing mechanism.

SUMMARY OF THE INVENTION

The object of the present invention is to provide a process and a device which can determine the position of a printed paper web in the direction of run of the paper web automatically without the use of printed marks in any state of the press. A preferred application is the automatic measurement and regulation of the cutting position of printed paper webs in rotary printing presses for printing newspapers.

In the process for determining the position of a printed paper web in a printing press, especially in a rotary printing press for printing newspapers, reference values are obtained according to the present invention for the position determination or position calculation from the image data of the preliminary printing stage, which are, e.g., digital or analog image data or the print originals.

The printing style or part of the printing style on the paper web in the printing press is detected with one or more sensors, e.g., optoelectronic sensors. The signals measured by the sensors are advantageously processed into suitable digital measured values.

The reference values of the preliminary printing stage or of the print originals are then compared with the measured values, e.g., the correlation of these values is examined and calculated. The position of the printed paper web in the direction of run can be calculated from the comparison of the reference values with the measured values. The position of a printed paper web can thus be determined accurately in a simple manner without applying an additional mark in the printing style.

The digital or analog image data from the publisher or from the preliminary printing stage may be, e.g., in the form of image contents of multicolor newspaper pages and delivered, e.g., in the form of files in the Postscript format or PDF format.

The digital image data from the publisher or from the preliminary printing stage may also be, e.g., in the form of image contents of the printing plates. The image data of a multicolor newspaper page are usually converted into half-tones by Raster Image Processing (RIP) and separated into the image data of the printing plates for the primary colors cyan, magenta, yellow, black. The digital image data of the corresponding printing plates are thus formed from the digital image data of a colored newspaper page. The separated image data of the printing plates are also called bit maps, RIP Pixel Maps or separations. The separated image data of the print originals can be supplied, e.g., as files in the TIFF-G4 format.

Reference values can be calculated from the digital image data from the publisher or from the preliminary printing stage. The reference values may indicate, e.g., the brightness curve on a narrow strip of a newspaper page.

An optoelectronic sensor in the printing press, which measures the brightness on the corresponding strip of the printed paper web, will then yield a similar brightness curve when the printed paper web is moved past by the sensor.

The position of the paper web in the direction of run can then be determined by comparing the measured values with the reference values, e.g., by correlating the measured brightness curves with the brightness curve calculated from the digital image data of the preliminary printing stage.

The position of the printed paper web in the direction of run, which is thus obtained, is advantageously used for the automatic regulation of the cutting position of the printed paper web in printing presses.

The device according to the present invention for determining the position of a printed paper web in a printing press, especially a rotary printing press for printing newspapers, comprises a data processing system for calculating the reference values from the preferably digital image data of the print original or the preliminary printing stage.

Furthermore, at least one, preferably optoelectronic sensor is provided for observing the printed paper web, which sensor can detect at least part of a printing style on the paper web.

The reference values obtained from the digital image data of the preliminary printing stage are compared in a comparing device with the measured values that were recorded by the optical sensor or the optical sensors in order to determine the position of the printed paper web from the difference or correlation of reference values and measured values. If the correlation is too weak, an error message can be generated.

The device according to the present invention advantageously also has a regulator, with which the cutting position of the paper web can be regulated, e.g., by actuating a compensator roller, using the actual position of the printed paper web thus obtained in the direction of run.

Advantageous embodiments of the process according to the present invention and the device according to the present invention will be described below, and the present invention will be described as an example on the basis of a preferred embodiment of a cutting position measurement and regulation. However, the present invention may also be used to determine or regulate the position of a printed paper web in other areas or for other purposes in a printing press.

Due to the evaluation of preferably digital image data from the publisher or from the preliminary printing stage and the use of suitable optical sensors for observing the printed paper web in the printing press, errors in the cutting position can be measured automatically and regulated by the regulator.

Using a suitable process, reference values can be calculated from the digital image contents from the publisher or from the preliminary printing stage. Measured values that can be compared with the reference values are supplied by optoelectronic sensors, which are arranged in the printing press as close to the cutting cylinder as possible and which detect the printing style on the paper web.

The actual value of the position of the printed paper web in the direction of run is determined by a comparison of the measured values with the reference values in a computing device by means of suitable methods, especially suitable correlation methods.

The position of the paper web in the direction of run, which is thus determined, can be subsequently sent as an actual value to a cutting position regulator. The cutting position regulator can then regulate the cutting position automatically by comparing the actual value with a preset set point. The setting value of the cutting position regulator can be used to actuate main registers, secondary registers, bundle registers or a virtual register.

Using this process, it is possible to automatically measure and regulate the cutting position at any time without applying an additional feature in the printing style. Automatic start-up of a printing press without manual interventions for correcting the cutting position is possible. The cutting position can also be regulated automatically continuously in the case of flying change from one edition to another.

The reference values can be formed by calculation from the image data of the preliminary printing stage. The reference values can be calculated directly from the print original, from the image data not converted into half-tones, from the image data converted into half-tones and subjected to color separation, or from the data of scanned printing plates or films according to a suitable process. The reference values can be standardized and stored in the printing press depending on the optical sensors by means of a computer such that a simple comparison or a direct correlation of the reference values with the measured values is possible.

For example, only a narrow strip of the printed paper web can be detected in the direction of run of the web by using, e.g., a contrast scanner as an optical scanner, which measures the reflected light intensity on the narrow image strip on the paper web and thus yields a curve of the brightness changes along this image strip. An especially suitable image strip may be advantageously selected by means of optimization methods in order to measure a brightness profile with a significant signal pattern. The reference values and the measured values may be stored in this case, e.g., in one-dimensional arrays of brightness values.

Large parts of the printing style can be compared with the use of an optical sensor system with CCD camera. The corresponding reference values and measured values may be stored, e.g., in multidimensional arrays.

The printing style is recorded on the printed paper web with a suitable optoelectronic sensor system. This may be carried out, e.g., with contrast scanners, CCD or CMOS cameras or linear cameras. The recording may be performed, e.g., continuously, and the position of the printed paper web in the direction of run can be determined, e.g., by forming a correlation coefficient.

As an alternative, the printed paper web may also be scanned section by section by means of a synchronization signal. The starting point of the image scanning is triggered now, e.g., synchronously with the rotation of the cutting cylinder in the printing press during each revolution at a certain angular position of the cutting cylinder by a start pulse, which can be supplied by a position transducer.

In case of the use of a contrast scanner, the amount of reflected light is detected along a narrow image strip in the direction of run of the paper web. The signals thus obtained can be digitized by a computing unit and advantageously stored in a one-dimensional array of measured values. It is advantageous for a plurality of contrast scanners to be distributed at right angles to the paper web so that an especially suitable image strip can be selected. It is also advantageous for these contrast scanners to be able to be positioned by a manual or automatic positioning unit on especially suitable strips of the printing style, where the positioning unit may be designed such that, e.g., a sensor is displaced dynamically continuously at right angles to the printed web to a determined, possibly optimal position.

In case of the use of CCD cameras, CMOS cameras or linear cameras, the entire printing style or parts thereof are recorded to determine the position of the printed paper web. The data obtained as a result can be advantageously stored in a multidimensional array of measured values.

The position of the printed paper web is determined by comparing the measured values with the reference values. It is particularly useful to use correlation methods or Fourier analyses for the comparison.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
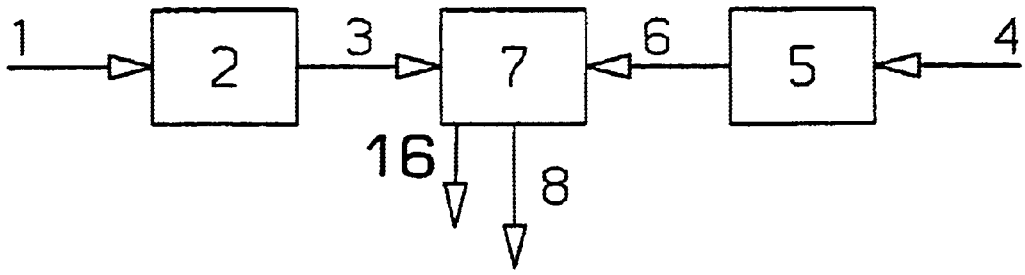
FIG. 1 is a flow diagram showing data flow during the calculation of the position of a printed paper web.

Referring to the drawings in particular, FIG. 1 shows the data flow during the calculation of the position of a printed paper web using digital image data of the preliminary printing stage. Reference values 3 are calculated from the image data 1 of the preliminary printing stage in a computing unit 2. The measured signals 4 are processed into measured values 6 in another unit 5 from the measured signal 4 from a sensor or from a plurality of sensors, which detect the printing style on the paper web, and the measured values 6 can be compared with the reference values 3 in a comparing unit 7. A signal 8, which indicates the position of the printed paper web, is obtained by the comparison or correction of the measured values 6 with the reference values 3. If the correction is too weak, an error message 16 is generated.

Figure 2:
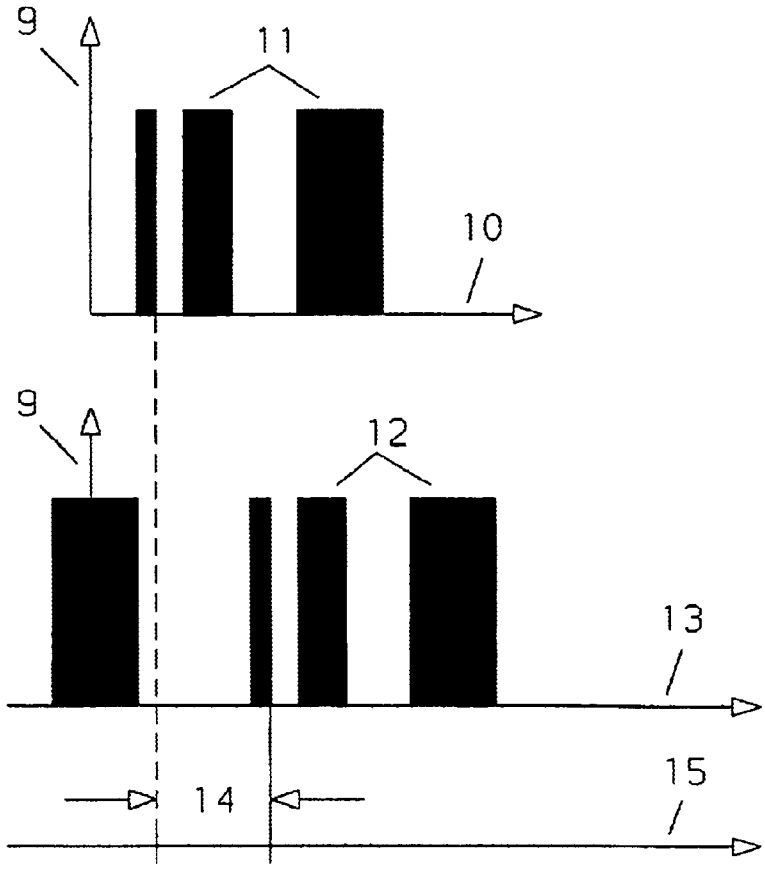
FIG. 2 is a view showing examples of reference values and measured values.

FIG. 2 shows examples of reference values 11 and measured values 12 and shows as an example how the position 14 of the printed paper web can be determined by comparing the reference values 11 and the measured values 12. The reference values 11 are shown in a diagram, in which the horizontal axis 10 shows the path in the vertical direction in the case of an image from the preliminary printing stage and the vertical axis 9 shows the brightness. In this example, the reference values 11 describe the brightness curve on a narrow vertical strip of the preliminary printing stage, e.g., a multicolor newspaper page. The measured values 12 describe in this example the brightness curve on a corresponding strip of the printed paper web in the direction of run of the paper web, represented over the axis 13. The reference values 11 and measured values 12 show similar brightness curves in this example. The position 14 of the printed paper web can be determined absolutely or relative to a fixed point by comparison of the brightness curves from the measured values 12 and the reference values 11.

Figure 3:
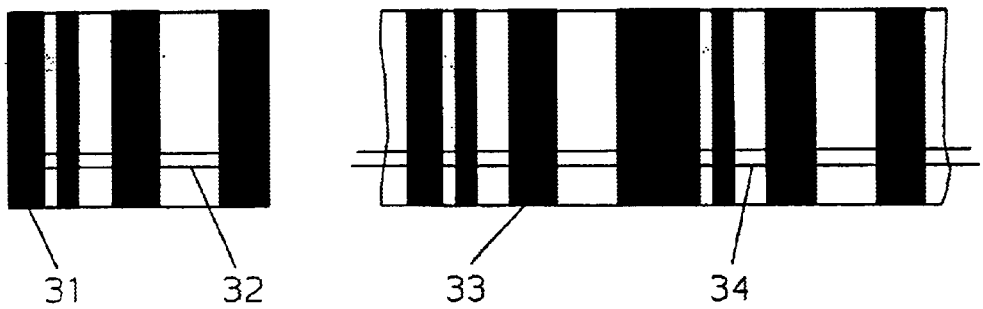
FIG. 3 is a view showing examples of a simple image data content from the preliminary printing stage and the corresponding printing style on the paper web.

FIG. 3 shows examples of a simple image data content 31 from the preliminary printing stage and the corresponding printing style 33 on the paper web. It is shown how an image strip 32 can be selected from the print original of the preliminary printing stage and how a corresponding strip 34 can be selected from the printing style 33 on the paper web.

Figure 4:
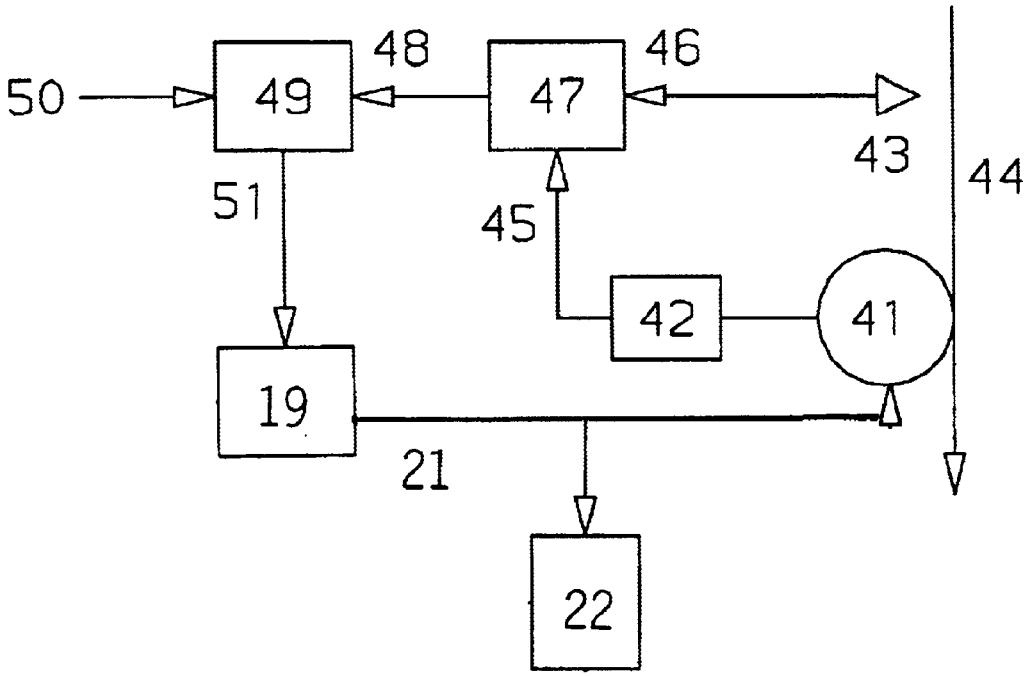
FIG. 4 is an a schematic view of an exemplary arrangement for determining the cutting position of a printed paper web in a printing press.

FIG. 4 shows an exemplary arrangement for determining the cutting position of a printed paper web in a printing press. Digital image data 50 from the preliminary printing stage are sent to a device 49 to calculate the position of the printed paper web.

The printing style on the paper web 44 is scanned by an optoelectronic sensor, which is arranged as close to the cutting cylinder 41 as possible. The measured signals 46 of the optical sensor 43 are synchronized with the position of the cutting cylinder 41. The angular position of the cutting cylinder is used for this purpose to synchronize the measured signals 46 of the optical sensor 43 in a synchronization device 47. The synchronized measured signals 48 of the optical sensor 43 thus have a fixed reference to the angular position of the cutting cylinder 41 and consequently to the cutting position thereof. The synchronized measured signal 48 of the optical sensor 43 is sent to the device 49 for calculating the position of the printed paper web, and a corresponding position signal 51 is sent.

In one embodiment, the position signal 51 can be sent to a regulator 19 which then adjusts the cutting cylinder 41 to correct for errors in the cutting position. The cutting position regulator 19 can then regulate the cutting position automatically by comparing the actual value with a preset set point. The setting value 21 of the regulator 19 can also be used to actuate main registers, bundle registers or a virtual register 22.

Figure 5:
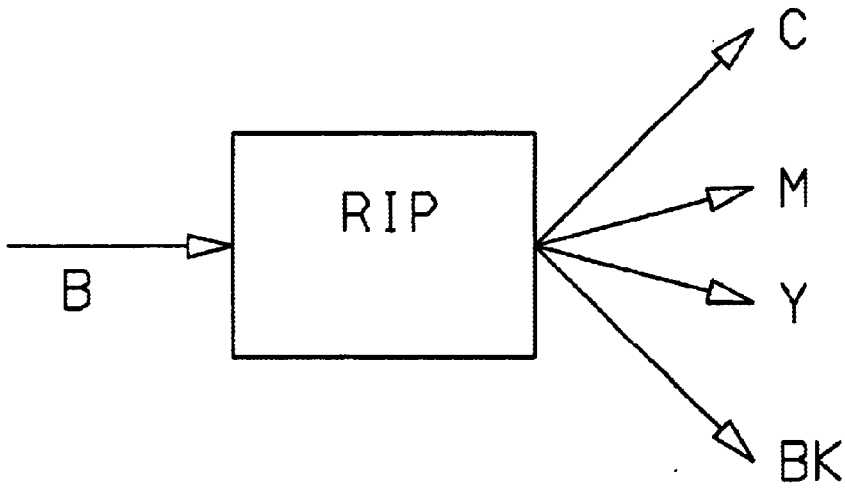
FIG. 5 is a view showing different types of image data in the preliminary printing stage.

FIG. 5 shows different types of image data in the preliminary printing stage. The image data B of the contents of a page, e.g., a multicolor newspaper page, are, e.g., in the Postscript format or in the PDF format. The image contents are calculated from the image data B of the contents of a page by Raster Image Processing (RIP) for the corresponding printing plates for the process colors cyan C, magenta M, yellow Y and black BK. The image data of the printing plates, which are converted into half-tones and subjected to color separation, are represented, e.g., in the TIFF G4 format.

Figure 6:
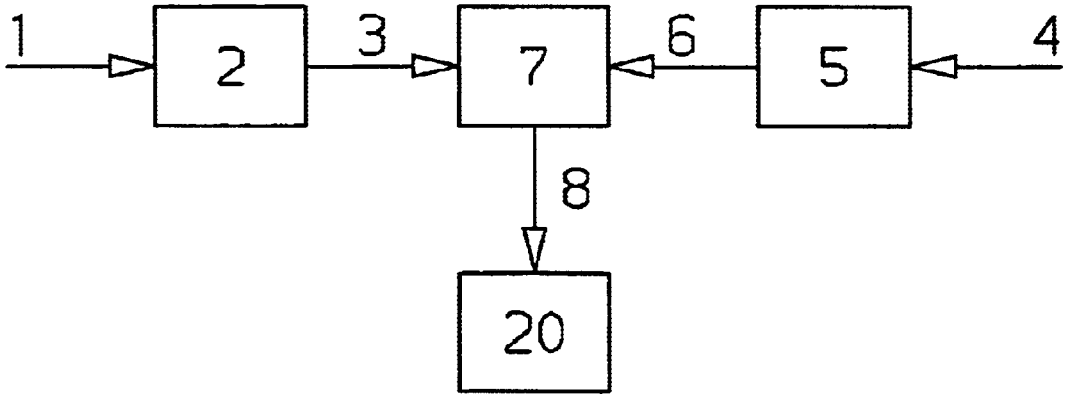
FIG. 6 is a view of a further aspect of the invention.

FIG. 6 shows a further aspect of the invention. In FIG. 6 there is shown the generation of the signal 8, as in FIG. 1. The signal 8 is received in FIG. 6 by a determining and/or regulating device 20. The determining and/or regulating device 20 determines and/or regulates the relative position of the printing style on the odd page of a paperweb relative to the printing style on the even page of the same paperweb.

While specific embodiments of the invention have been shown and described in detail to illustrate the application of the principles of the invention, it will be understood that the invention may be embodied otherwise without departing from such principles.

What is claimed is:

1. A process for determining the position of a printed paper web in a printing press, the process comprising:

obtaining reference values for determining the position from image data of a preliminary printing stage;

detecting at least part of a printing style on the paper web using at least one sensor;

obtaining reference values from the image data of the preliminary printing stage and comparing the obtaining reference values with measured values detected by the at least one sensor;

determining the position of the printed web from the result of the comparison;

determining and/or regulating the relative position of the printing styles on the odd page of a paper web relative to the printing styles on the even page of the same paper web.

2. A process in accordance with claim 1, wherein the reference values for determining the position are obtained from the image contents of a print original including image data of a multicolor newspaper page, or from the image data converted into half-tones and subjected to color separation for the exposure of the printing plates or from the image data of scanned printing plates or scanned films.

3. A process in accordance with claim 1, wherein the at least one sensor is a CCD camera and/or a CMOS camera and/or a linear camera and/or a contrast scanner.

4. A process in accordance with claim 1, wherein at least part of the printing style on the paper web is detected synchronously with the movement of a part of the press, synchronously with the rotation of a cutting cylinder.

5. A process in accordance with claims 1, further comprising using the position of the printed paper web is used for regulating as an actual value.

6. A process in accordance with claim 1, wherein the position of the paper web and/or the cutting position of the printed paper web in a rotary printing press is measured and/or regulated with a main register and/or secondary register and/or bundle register and/or a virtual register.

7. A process in accordance with claim 1, further comprising recognizing errors in mounting during the arrangement of printing plates on the printing cylinders in a printing press, wherein an error message is automatically generated when the correlation between the measured values and the set points is too weak during the comparison of the measured values with the reference values.

8. A device for determining the position of a printed paper web in a printing press, the device comprising:

a data processing device determining reference values for determining a position from image data of a preliminary printing stage;

at least one sensor for detecting at least part of a printing style on the paper web and providing measured values, the sensor being an optoelectronic sensor;

a comparing device comparing the reference values and measured values from at least one sensor with one another in order determine a position of the printed paper web therefrom;

a regulating device for regulating the position of a paper web, said regulating device using the determined position of the printed paper web as an input signal;

wherein the comparing device and/or the regulating device perform at least one of the steps of:

obtaining reference values for determining the position from image data of a preliminary printing stage;

detecting at least part of a printing style on the paper web;

obtaining reference values from the image data of the preliminary printing stage;

comparing the obtaining reference values with measured values detected by the at least one sensor;

determining the position of the printed web from the result of the comparison;

using the position of the printed paper web determined for regulating using the position as an actual value;

using the position of the paper web and/or the cutting position of the printed paper web in a rotary printing press to measure and/or regulate with a main register and/or secondary register and/or bundle register and/or a virtual register;

recognizing errors in mounting during the arrangement of printing plates on the printing cylinders in a printing press, wherein an error message is automatically generated when the correlation between the measured values and the set points is too weak during the comparison of the measured values with the reference values; and determining and/or regulating the relative position of the printing styles on the odd page of a paper web relative to the printing styles on the even page of the same paper web.

9. A device in accordance with claim 8, wherein the optoelectronic sensor is one or more of a CCD camera a CMOS camera a linear camera and a contrast scanner.

10. A device in accordance with claim 8, wherein the device is provided in combination with a rotary printing press.

11. A process for determining the position of a printed paper web in a printing press, the process comprising:

using a rotary printing press to print on the paper web;

obtaining reference values for determining the position from image data of a preliminary printing stage;

detecting at least part of a printing style on the paper web using one or more sensors;

obtaining reference values from the image data of the preliminary printing stage and comparing the obtaining reference values with measured values detected by the at least one sensor; and determining the position of the printed web from the result of the comparison;

determining and/or regulating the relative position of the printing styles on the odd page of a paper web relative to the printing styles on the even page of the same paper web.

12. A process in accordance with claim 11, wherein the one or more sensors include at least one optoelectronic sensor provided as one of a CCD camera, a CMOS camera, a linear camera and a contrast scanner.

13. A process for determining the position of a printed paper web in a printing press, the process comprising:

obtaining reference values for determining the position from image data of a preliminary printing stage;

detecting at least part of a printing style on the paper web using at least one sensor;

obtaining reference values from the image data of the preliminary printing stage and comparing the obtaining reference values with measured values detected by the at least one sensor; and determining the position of the printed web from the result of the comparison;

recognizing errors in mounting during the arrangement of printing plates on the printing cylinders in a printing press, wherein an error message is automatically generated when the correlation between the measured values and the set points is too weak during the comparison of the measured values with the reference values.

* * * * *